US006206988B1

(12) United States Patent
Bazaki

(10) Patent No.: US 6,206,988 B1
(45) Date of Patent: Mar. 27, 2001

(54) HEXANITROHEXAAZAISOWURTZITANE COMPOSITIONS AND EXPLOSIVE COMPOSITIONS CONTAINING THE SAME

(75) Inventor: Hakobu Bazaki, Oita (JP)

(73) Assignee: Asahi Kasei Kogyo Kabushiki Kaisha, Osaka (JP)

( * ) Notice: Subject to any disclaimer, the term of this patent is extended or adjusted under 35 U.S.C. 154(b) by 0 days.

(21) Appl. No.: 09/308,854

(22) PCT Filed: Apr. 9, 1998

(86) PCT No.: PCT/JP98/01634

§ 371 Date: May 26, 1999

§ 102(e) Date: May 26, 1999

(87) PCT Pub. No.: WO99/26900

PCT Pub. Date: Jun. 3, 1999

(30) Foreign Application Priority Data

Nov. 26, 1997 (JP) ..... 9-339484

(51) Int. Cl.[7] ..... C06B 45/10; C06B 25/34

(52) U.S. Cl. ..... 149/19.6; 149/19.1; 149/19.4; 149/19.7; 149/19.8; 149/19.9; 149/92

(58) Field of Search ..... 149/19.1, 19.4, 149/92, 19.7, 19.8, 19.9, 19.6

(56) References Cited

U.S. PATENT DOCUMENTS

| | | | | |
|---|---|---|---|---|
| 5,467,714 | | 11/1995 | Lund et al. . | |
| 5,468,313 | | 11/1995 | Wallace, II et al. . | |
| 5,487,851 | | 1/1996 | Dillehay et al. . | |
| 5,529,649 | * | 6/1996 | Lund et al. | 149/19.4 |
| 5,587,553 | * | 12/1996 | Braithwaite et al. | 149/19.6 |
| 5,693,794 | * | 12/1997 | Nielsen | 149/92 |
| 5,716,557 | * | 2/1998 | Srauss et al. | 149/19.6 |
| 5,739,325 | * | 4/1998 | Wardle et al | 149/92 |
| 5,942,721 | * | 8/1999 | Dawson | 149/92 |

FOREIGN PATENT DOCUMENTS

| | | |
|---|---|---|
| 7242482 | 9/1995 | (JP) . |
| 95 17358 | 6/1995 | (WO) . |

* cited by examiner

*Primary Examiner*—Edward A. Miller
(74) *Attorney, Agent, or Firm*—Birch, Stewart, Kolasch & Birch, LLP.

(57) ABSTRACT

Hexanitrohexaazaisowurtzitane-containing compositions which comprise hexanitrohexaazaisowurtzitane, polynitropolyacetylhexaazaisowurtzitanes and one or more of oxaisowurtzitane compounds represented by the specified formulae. The explosive compositions which contain the hexanitrohexaazaisowurtzitane-containing compositions have improved handling safety by lowering their sensitivity without degrading combustibility and detonability.

11 Claims, No Drawings

HEXANITROHEXAAZAISOWURTZITANE COMPOSITIONS AND EXPLOSIVE COMPOSITIONS CONTAINING THE SAME

This application is the national phase under 35 U.S.C. §371 of PCT International Application No. PCT/JP98/01634 which has an International filing date of Apr. 9, 1998 which designated the United States of America.

TECHNICAL FIELD

The present invention relates to compositions which contain hexanitrohexaazaisowurtzitane as a major component and explosive compositions which contain the hexanitrohexaazisowurtzitane-containing compositions. The compositions of the present invention are excellent in not only performance in terms of ignitability, combustibility, detonability and the like, but also insensitivity to provide improved handling safety.

BACKGROUND ART

Explosive materials are classified into explosives used for blasting and the like, and combustion compositions which give off gas and heat while burning without an outside supply of air or oxygen. Generally, examples of the explosives include nitroglycerin-containing dynamite, ANFO prepared by mixing ammonium nitrate with fuel oils, PBX (Plastic Bonded Explosives) prepared by binding hexogen (RDX) or octogen (HMX) with polymeric binders, and bursting explosives containing trinitrotoluene, RDX or HMX as a major component. These compositions may easily be exploded by means of detonators or fuses. On the other hand, examples of combustion compositions include difficult-to-detonate gun and rocket propellants, which are prepared by mixing solid oxidizers such as ammonium perchlorate, ammonium nitrate, HMX, RDX and the like with polymeric binders, nitrocellulose, or the like. Research has been performed up to the present with the goal of improving the performance of these propellants by seeking for and developing materials having a high energy density per unit of weight or volume. One means of achieving this is by using high energy density materials such as hexanitrohexaazaisowurtzitane, hexanitrohexaazaadamantane, octanitrocubene, or the like. An example is given in pages 228 and 229 of a paper distributed at the Energetic Materials Summer Conference of Jul. 25, 1989 that CL-20 described in the "Critical Technology Plan" edited by the USDOD (United States Department of Defense), which is noted in the February 1992 issue of "Boei Gijutsu (Defense Technology Journal)", is hexanitrohexaazaisowurtzitane. According to the paper, hexa-nitrohexaazaisowurtzitane has a density of 1.98, a detonation pressure of 432 Kbar and an energy density of 455 cal/cm$^3$. From this it follows that hexanitrohexaazaisowurtzitane has a density higher by ca. 4%, a detonation pressure higher by ca. 10% and an energy density ca. 4.2 times higher than those of HMX (density: 1.90, detonation pressure: 391 Kbar, energy density: 109 cal/cm$^3$), which has been superior in performance to any other conventional explosive materials.

The sensitivity of hexanitrohexaazaisowurtzitane is amost equal to that of HMX in the condition in which it is usually produced, but higher than that of HMX in a certain crystalline form, so that precaution is required for its handling. Attempts have been made to lower the sensitivity by use of inert plasticizers, but there still remain problems such as separation of hexanitrohexaazaisowurtzitane from the inert plasticizer due to mutual incompatibility and deterioration of performance in terms of ignitability, combustibility, detonability and the like because of inertness of the plasticizers.

It is accordingly an object of the present invention to provide explosive compositions which are improved in handling safety without degrading performance in terms of ignitability, combustibility, detonability and the like by selection of plasticizers that have good compatibility with hexanitrohexaazaisowurtzitane while lowering the sensitivity.

DISCLOSURE OF THE INVENTION

As a result of making intensive research to solve the above-mentioned problems, the inventor has completed the present invention, based upon the findings that the hexanitrohexaazaisowurtzitane compositions which have a safer level of handling sensitivity may be obtained without lowering performance in terms of ignitability, combustibility, detonability and the like by mixing hexanitrohexaazaisowurtzitane with polynitropolyacetylhexaazaisowurtzitanes and oxaisowurtzitane compounds (hexanitrohexaazaisowurtzitane derived oxa compounds) which are excellent in compatibility with hexanitrohexaazaisowurtzitane, because of resemblance between them in skeleton structure. The oxaisowurtzitane compounds are represented by the following formulae (1) through (5):

(1)

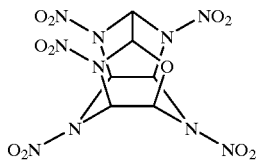

(2)

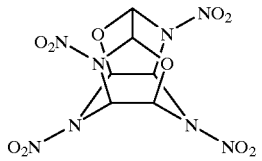

(3)

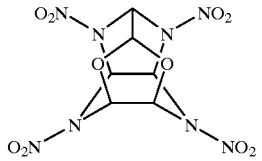

(4)

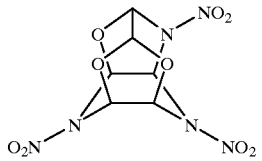

(5)

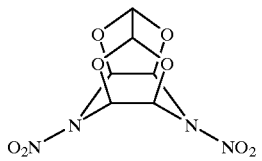

Accordingly, the present invention provides the hexanitrohexaazaisowurtzitane-containing compositions which are prepared by mixing hexanitrohexaazaisowurtzitane with polynitropolyacetylhexaazaisowurtzitanes and one or more of oxaisowurtzitane compounds represented by the formulae (1) through (5). The content of the polynitropolyacetylhexaazaisowurtzitane ranges from 0.1 to 5 percent by weight and the content of the oxaisowurtzitane compound ranges from 0.01 to 0.5 percent by weight. The polynitropolyacetylhexaazaisowurtzitanes include dinitrotetraacetylhexaazaisowurtzitane, trinitrotriacetylhexaazaisowurtzitane, tetranitrodiacetylhexaazaisowurtane and pentanitromonoacetylhexaazaisowurtzitane, which may be used either independently or in a combination of two or more for preparation of said hexanitrohexaazaisowurtzitane-containing compositions.

Furthermore, the present invention provides an explosive composition prepared by mixing a conventional explosive, or the explosive components of such a conventional explosive, with the above-mentioned hexanitrohexaazaisowurtzitane-containing compositions. In order to prevent the performance of the composition from degrading, for example, to reduce the range of a decrease in the detonation velocity of the composition by several percent or less, the content of the polynitropolyacetylhexaazaisowurtzitane should range preferably from 0.1 to 5 percent by weight and the content of the oxaisowurtzitane compound should range preferably from 0.01 to 1.0 percent by weight. If the content of the polynitropolyacetylhexaazaisowurtzitane is more than 5 percent by weight or if the content of the oxaisowurtzitane compound is more than 1.0 percent by weight, the performance of the explosive composition is undesirably lowered.

If the content of the polynitropolyacetylhexaazaisowurtzitane is less than 0.1 percent by weight, the handling sensitivity of the composition is undesirably increased. If the content of the oxaisowurtzitane compound is less than 0.01, the handling sensitivity is also increased. More preferably, the content of the polynitropolyacetylhexaazaisowurtzitane ranges 0.2 to 2 percent by weight, and the content of the oxaisowurtzitane compound ranges from 0.01 to 0.2 percent by weight.

Polynitropolyacetylhexaazaisowurtzitanes include dinitrotetraacetylhexaazaisowurtzitane, trinitrotriacetylhexaazaisowurtzitane, tetranitrodiacetylhexaazaisowurtzitane and pentanitromonoacetylhexaazaisowurtzitane, which may be preferably used either independently or in a combination of two or more.

It is possible to improve the performance of conventional explosives by full or partially substituting the explosives with the hexanitrohexaazaisowurtzitane compositions which contain the polynitropolyacetylhexaazaisowurtzitanes and the oxaisowurtzitane compounds.

Typical examples of the conventional explosives which have been used include trinitrotoluene (TNT), trinitroazetidine (TNAZ), burster compositions obtained by melt mixing RDX or HMX with said explosives and so-called PBX prepared by binding RDX or HMX with polymeric binders. Typical examples of the conventional explosives, which are used as gun or rocket propellants, include solid compositions obtained by binding solid oxidizers such as ammonium perchlorate, ammonium nitrate, HMX, RDX and the like with polymeric binders and compositions prepared by mixing high-energy solid materials such as HMX, RMX, nitroguanidine and the like with a mixture of nitrocellulose and nitroglycerin.

Full or partial replacement of these solid oxidizers or high-energy solid materials with the hexanitrohexaazaisowurtzitane compositions of the present invention provides explosives in which performance is improved in spite of their handling sensitivity level being safer than or equal to that of the conventional explosives.

Blending hexanitrohexaazaisowurtzitane compositions of the present invention with conventional explosives is performed using binders. The binders include hydroxyl terminated or hydroxyl end group-free compounds. Selection of the binders depends on the application purposes of the explosives and on the conditions under which the explosives are used.

Examples of the hydroxyl terminated compounds which may be used as binders according to the present invention include inert compounds such as hydroxyl-terminated polybutadienes, polypropylene glycols and the like and polyethers containing one or more of nitrato and azido groups such as copolymers of nitratomethyloxetane and bisazidomethyloxetane. These compounds are cured by urethane bonding brought about by reaction with isocyanates such as isophoronediisocyanate and the like.

Examples of the hydroxyl end group-free compounds which may be preferably used as binders are thermoplastic polymers such as powdered polypropylene or cellulose ester polymers such as nitrocellulose, cellulose acetate butyrate, cellulose acetate propionate and the like.

When the hexanitrohexaazaisowurtzitane composition of the present invention is blended with a binder, the content of said composition ranges from preferably 55 to 95 percent by weight. If the content of the explosive composition is less than 55 percent by weight, for example, then when blending the composition with hydroxyl-terminated polybutadiene, a uniform dispersion cannot be attained because the composition precipitates by gravity during the curing process. If the content of the hexanitrohexaazaisowurtzitane composition is more than 95 percent by weight, then a blend of the composition and the binder cannot be molded into a desirable shape because the composition mixes badly with the binder.

BEST MODE FOR PRACTICING THE INVENTION

The present invention will be described below in more detail with reference to the following examples and comparative examples.

EXAMPLE 1

An hexanitrohexaazaisowurtzitane composition consisting of 98 percent by weight of hexanitrohexaazaisowurtzitane, 1.9 percent by weight of pentanitromonoacetylhexaazaisowurtzitane, and 0.1 percent by weight of 4,10-dinitro-2,6,8,12-tetraoxa-4,10-diazatetracylo[5.5.0.0$^{6,9}$. 0$^{3,11}$]dodecane (TEX) represented by formula (5) was blended with a binder, containing bisazidomethyloxetanenitratomethyloxetane copolymer having hydroxyl groups at both ends (BAMO-NMMO) as a major component, at a ratio of 90 to 10, composition:binder, on a weight basis. The binder consisted of 75 percent by weight of the BAMO-NMMO, 8.84 percent by weight of isophoronediisocynate as a curing agent, 1.16 percent by weight of trimethylolpropane as a crosslinking agent, and 15 percent by weight of dioctyl adipate as a plasticizer per 100 percent by weight of said binder.

The above-mentioned components were blended with each other in a blender at 50° C. for ca. 30 minutes. The resulting blend was packed into steel pipes having an inside diameter of 30 mm and a length of 200 mm. The detonation velocity of the blend thus molded was measured according to the ion gap method described in an explosives handbook, and it was found that the blend had a detonation velocity of ca. 8,820 m/s. The molded blend was subsequently ground into particles passable through a 10 mesh sieve, and their fall hammer sensitivity was measured by the method ES-21 (1) described in the Explosives Society Standards. Results showed that the particles had a fall hammer sensitivity of grade 6 on a one to six sensitivity scale.

EXAMPLE 2

Seventy-six percent by weight of an hexanitrohexaazaisowurtzitane composition consisting of 98 percent by weight of hexanitrohexaazaisowurtzitane, 1.9 percent by weight of pentanitromonoacetylhexaazaisowurtzitane and 0.1 percent by weight of TEX; 12 percent of by weight of cellulose acetate butyrate as a binder; 4 percent by weight of nitrocellulose as another binder; 7.6 percent by weight of acetyl triethyl citrate as a plasticizer; and 0.4 percent by weight of ethyl centralite as a stabilizer were blended with an ethyl acetate-ethyl alcohol solution (consisting of ethyl acetate and ethyl alcohol at a weight ratio of 60 to 40) in a kneading machine until a uniform blend was obtained. The blend was extruded under pressure with a solvent extrusion machine and cut into so-called seven perforated grains, each of which was a cylinder having an outside diameter of ca. 4 mm and a length of ca. 10 mm. Each of the grains had seven bores, each of which had a diameter of 0.3 mm. The grains were dried at ca. 50° C. for 10 days to such an extent that their solvent content was decreased to 0.5 percent by weight or less per 100 percent of the grain weight.

The dried grains were placed in a closed bomb type test apparatus and their maximum combustion pressure was measured. The obtained maximum combustion pressure was converted to an impetus value, which was 1,070 J/g. Measurement of the grains with a fall hammer test apparatus indicated that they had a fall hammer sensitivity of grade 6 on the scale.

COMPARATIVE EXAMPLE 1

Moldings and their ground particles were prepared in the same manner as described in Example 1 from a blend which consisted of 90 percent by weight of an hexanitrohexaazaisowurtzitane composition consisting of 99.5 percent by weight of hexanitrohexaazaisowurtzitane and 0.5 percent by weight of TEX and 10 percent by weight of a BAMO/NMMO-containing binder whose composition was the same as that of the binder used in Example 1.

As a result of measuring the moldings in the same way as described in Example 1, it was indicated that their detonation velocity was ca. 8,840 m/s, while it was shown that the fall hammer sensitivity of the particles was grade 5 on the scale.

COMPARATIVE EXAMPLE 2

Grains were prepared in the same way as described in Example 2 by use of 90 percent by weight of an hexanitrohexaazaisowurtzitane composition consisting of 99.5 percent by weight of hexanitrohexaazaisowurtzitane and 0.5 percent by weight of TEX and 10 percent by weight of a blend consisting of the same components, including the binders and others, as used in Example 2.

The maximum combustion pressure of the grains was measured by use of a closed bomb test apparatus in the same way as describe in Example 2, and it was found that their impetus was 1,075 J/g. Measurement of the grains with a fall hammer test apparatus indicated that the grains had a fall hammer sensitivity of grade 5 on the scale.

INDUSTRIAL APPLICABILITY

The hexanitrohexaazaisowurtzitane compositions of the present invention are useful as components in rocket propellants, explosives and similar applications which require more safety than conventional explosives, while retaining high performance.

What is claimed is:

1. A hexanitrohexaazaisowurtzitane composition which comprises hexanitrohexaazaisowurtzitane and 0.1–5 percent by weight of a polynitropolyacetylhexaazaisowurtzitane and 0.01–1.0 percent by weight of at least one of oxaisowurtzitane compounds (hexanitrohexaazaisowurtzitane derived oxa compounds) represented by the following formulae (1) through (5):

(1)

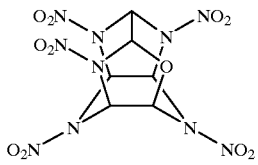

(2)

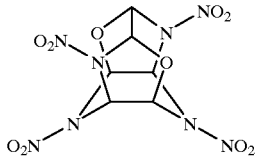

(3)

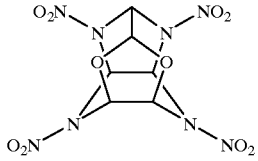

(4)

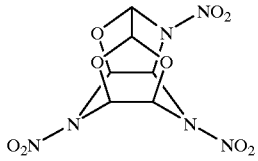

(5)

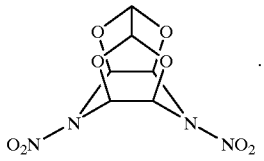

2. The hexanitrohexaazaisowurtzitane composition as defined in claim 1, wherein said composition contains at least one of polynitropolyacetylhexaazaisowurtzitanes which include dinitrotetraacetylhexaazaisowurtzitane, trinitrotriacetylhexaazaisowurtzitane, tetranitrodiacetylhexaazaisowurtzitane and pentanitromonoacetylhexaazaisowurtzitane.

3. The hexanitrohexaazaisowurtzitane composition as defined in claim 1 or 2 which further comprises a binder.

4. The hexanitrohexaazaisowurtzitane composition as defined in claim 3, wherein the binder comprises at least one hydroxyl end group containing compound.

5. The hexanitrohexaazaisowurtzitane composition as defined in claim 4, wherein the hydroxyl end group containing compound is hydroxyl-terminated polybutadiene or polypropylene glycol.

6. The hexanitrohexaazaisowurtzitane composition as defined in claim 4, wherein the binder comprises at least one of hydroxyl end group containing polyethers which contain at least one of nitrato or azido groups.

7. The hexanitrohexaazaisowurtzitane composition as defined in claim 3, wherein the binder comprises thermoplastic polymers.

8. The hexanitrohexaazaisowurtzitane composition as defined in claim 3, wherein the binder comprises at least one compound selected from the group consisting of nitrocellulose, cellulose acetate butyrate and cellulose acetate propionate.

9. A hexanitrohexaazaisowurtzitane composition comprising:

(A) a binder; and 55 to 95 percent by weight of (B) a composition which comprises hexanitrohexaazaisowurtzitane and 0.1–5 percent by weight of a polynitropolyacetylhexaazaisowurtzitane and 0.01 to 1.0 percent by weight of at least one of oxaisowurtzitane compounds (hexanitrohexaazaisowurtzitane derived oxa compounds) represented by the following formulae (1) through (5):

(1)

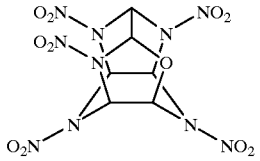

(2)

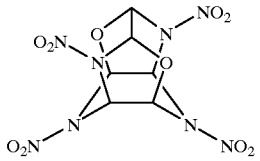

-continued (3)

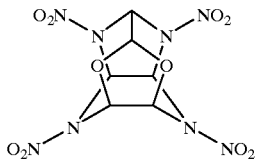

(4)

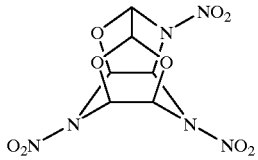

(5)

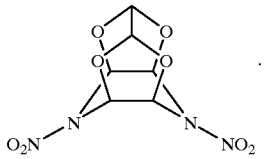

10. The hexanitrohexaazaisowurtzitane composition as defined in claim 9, wherein the polynitropolyacetylhexaazaisowurtzitane is at least one of dinitrotetraacetylhexaazaisowurtzitane, trinitrotriacetylhexaazaisowurtzitane, tetranitrodiacetylhexaazaisowurtzitane and pentanitromonoacetylhexaazaisowurtzitane.

11. The hexanitrohexaazaisowurtzitane composition as defined in claim 1, wherein the polynitropolyacetylhexaazaisowurtzitane is present in a concentration of 0.2–5% percent by weight.

* * * * *